US006742194B2

(12) United States Patent
Shim

(10) Patent No.: US 6,742,194 B2
(45) Date of Patent: Jun. 1, 2004

(54) DUAL CAPACITY FLUSH VALVE ASSEMBLY FOR A TOILET

(76) Inventor: Peter Shim, 21 Sundown Cl. S.E., Calgary, Alberta (CA), T2X 2X3

( * ) Notice: Subject to any disclaimer, the term of this patent is extended or adjusted under 35 U.S.C. 154(b) by 0 days.

(21) Appl. No.: 10/347,351

(22) Filed: Jan. 21, 2003

(65) Prior Publication Data

US 2004/0040077 A1 Mar. 4, 2004

Related U.S. Application Data

(60) Provisional application No. 60/406,337, filed on Aug. 28, 2002.

(51) Int. Cl.[7] ..... E03D 1/14; E03D 1/34

(52) U.S. Cl. ..... 4/325; 4/386

(58) Field of Search ..... 4/385, 386, 324, 4/325

(56) References Cited

U.S. PATENT DOCUMENTS

| | | | | |
|---|---|---|---|---|
| 1,233,684 A | | 7/1917 | Meyer et al. | |
| 1,893,202 A | | 1/1933 | Gilmore | |
| 3,935,598 A | | 2/1976 | Schmidt | |
| 4,080,669 A | | 3/1978 | Biggerstaff | |
| 4,138,749 A | | 2/1979 | Clark | |
| 4,145,774 A | | 3/1979 | Sullivan | |
| 4,225,987 A | | 10/1980 | Goldman et al. | |
| 4,419,773 A | | 12/1983 | Sullivan | |
| 4,433,445 A | | 2/1984 | Morris et al. | |
| 4,447,919 A | | 5/1984 | Mobilia | |
| 4,624,018 A | | 11/1986 | Kurtz | |
| 4,979,241 A | | 12/1990 | Jomha et al. | |
| 5,129,110 A | | 7/1992 | Richter | |
| 5,148,554 A | | 9/1992 | Martin | |
| 5,153,948 A | | 10/1992 | Smith et al. | |
| 5,191,662 A | * | 3/1993 | Sharrow | 4/325 |
| 5,205,000 A | | 4/1993 | Xia et al. | |
| 5,206,960 A | | 5/1993 | Hooshley et al. | |
| 5,228,144 A | | 7/1993 | Kightlinger | |
| 5,289,594 A | | 3/1994 | Wiewiorowski et al. | |
| 5,428,848 A | | 7/1995 | Battle | |
| 5,524,297 A | | 6/1996 | Harrison | |
| 5,673,440 A | | 10/1997 | Carmona | |
| 5,699,563 A | | 12/1997 | McClure | |
| 5,794,279 A | | 8/1998 | Schwartz | |
| 6,263,520 B1 | * | 7/2001 | Song | 4/325 |
| 6,311,342 B1 | | 11/2001 | Hwang | |

FOREIGN PATENT DOCUMENTS

| | | |
|---|---|---|
| EP | 1195475 | 7/2001 |

* cited by examiner

*Primary Examiner*—Charles E. Phillips
(74) *Attorney, Agent, or Firm*—Sean W. Goodwin

(57) ABSTRACT

A dual-flush flapper valve assembly, set for a normally short flush, is provided for use with a pivoting flapper valve in a flush tank. The assembly comprises a weight, which moves back and forth along a guide relative to the flapper's pivot point. The moveable weight, if activated, temporarily reduces the turning moment arm of the flapper for ensuring a long flush. The assembly further comprises an actuator to trap and release the weight, resulting in either a short flush (when the weight is remote from the pivot) or a long flush (when the weight is close to the pivot). The flapper assembly is engageable through a resistance force, for selectively triggering the actuator, shifting the weight and resulting in a long flush. After a long flush the assembly resets for a short flush, until activated once again.

10 Claims, 13 Drawing Sheets

10
8
10b
A'
1
12
4
11
2
9
D'
14
7a
15
6
7
3
3b
7b
3d
13
3c
5
3a
4b 10
8
A'
10b
1
12
11
4
2
7c
9
B'
D'
14
7a
2
7
3
C'
7b
3b
15
6
E
3d
13
5
3a
4b

DUAL CAPACITY FLUSH VALVE ASSEMBLY FOR A TOILET

CROSS REFERENCE TO RELATED APPLICATION

This application is related to and claims the benefit of a co-pending U.S. Provisional application Serial No. U.S. 60/406,337, filed on Aug. 28, 2002, the entirety of which is incorporated herein by reference.

FIELD OF THE INVENTION

The present invention relates generally to a toilet tank flapper which has a short flush and a long flush capability. More particularly, the adjustable flapper uses a moveable weight which, if activated, will temporarily reduce the turning moment arm of the flapper for ensuring a long flush.

BACKGROUND OF THE INVENTION

It is a well known fact that a large use of water in most households, and in many office buildings, is for flushing toilets. Because the flushing is typically carried out with the full capacity of the water in the water tank, the water usage is often wasteful and not required; such as when flushing liquid wastes. For water conservation reasons considerable interest has been centered on designing flushing systems and mechanisms that uses a short duration flush for liquids and a longer duration flush for solids (i.e. a dual-flush toilet).

Examples of prior art dual-flush mechanisms, which afford a degree of user control over the amount of water used per flush, are U.S. Pat. Nos. 3,935,598, 4,225,987, 4,433, 445, 5,129,110, 5,205,000 and 5,524,297. All of the above references, however, lack one or more necessary elements for successful wide utilization in the industry. That is, these prior art references may be prohibitively expensive, too complicated to install, maintain or operate, require the user to hold down the handle for several seconds during the flushing cycle, or may be difficult to retro-fit into existing toilets.

What is needed is a flushing mechanism or system which will provide a dual-flush capability and which does not have the above-mentioned disadvantages.

SUMMARY OF THE INVENTION

In one embodiment, a pivoting flapper valve assembly, set for a normally short flush, is provided for use in a flush tank. The flapper assembly comprises a weight, which shifts back and forth relative to the assembly's pivot point. The assembly further comprises an actuator to trap and release the weight, resulting in either a short flush (when the weight is remote from the pivot) or a long flush (when the weight is close to the pivot). The flapper assembly is engageable through a resistance force, for selectively triggering the actuator, shifting the weight and resulting in a long flush.

More specifically, the assembly includes flush sustaining means preset to maintain the flapper assembly in the open position for a short time (i.e. a short flush). The assembly's shifting weight, or turning moment arm shifting means, reduces the turning moment arm of the assembly when it shifts closer to the pivot, thereby causing the flush sustaining means to hold the assembly open for a longer time (i.e. long flush).

In a preferred embodiment, the moment arm shifting means comprises a longitudinal guide mounted for displacement with the assembly, a weight slidably constrained within the guide and retaining means (releasable by the resistance force) to retain the weight at the end of the guide furthest from the assembly's pivot point. In one embodiment of the invention, the retaining means comprises a magnetic coupling device. In another embodiment, the retaining means comprises a pivoting lever mechanism.

DETAILED DESCRIPTION OF THE PREFERRED EMBODIMENTS

Figure 1:
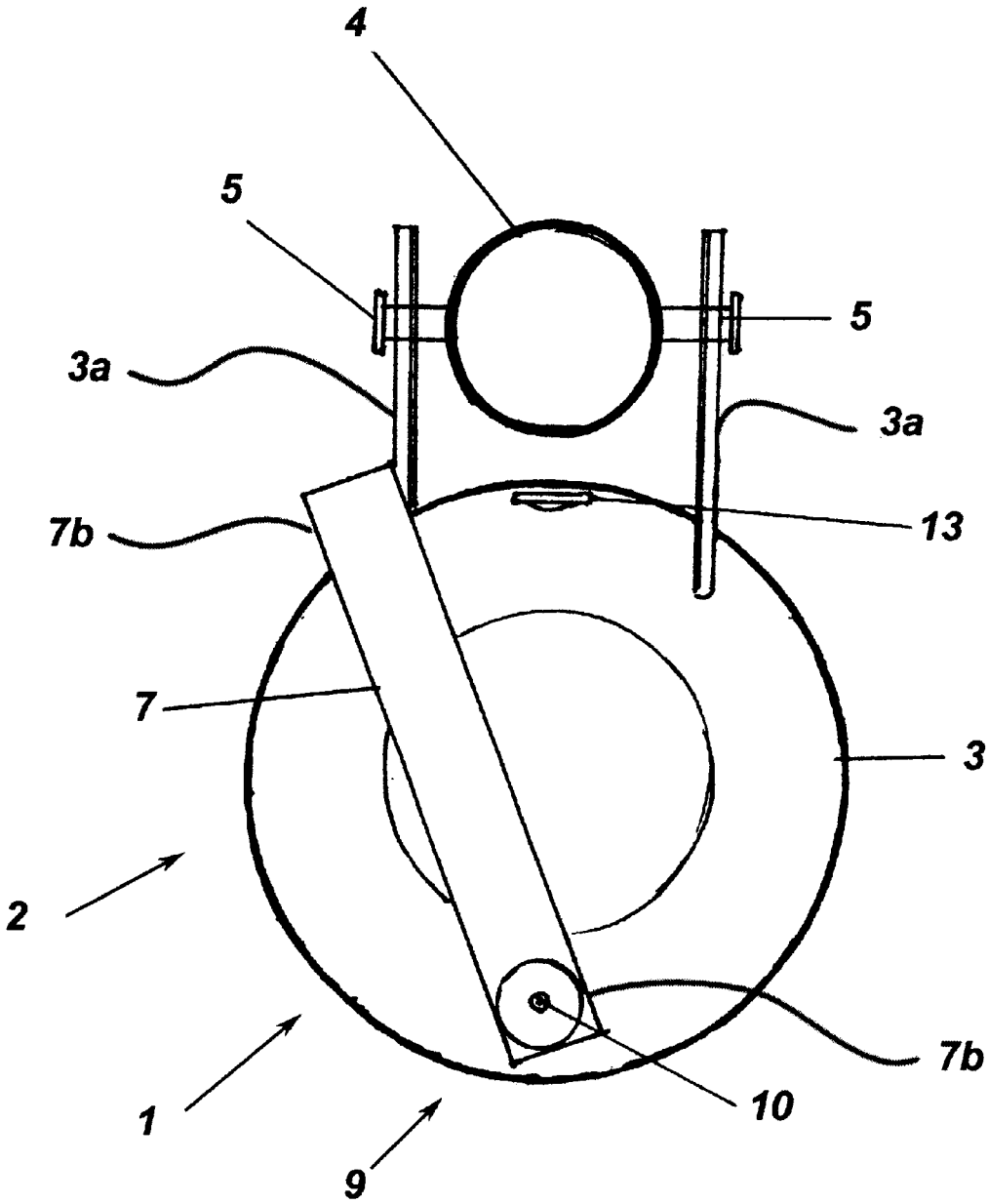
FIG. 1 is a top view of one embodiment of the invention.

With reference to FIGS. 1–5, in a first embodiment, a flapper valve assembly 1 is adapted with turning moment arm shifting means 2. A substantially conventional flapper or flapper valve 3 is attached to a flush tube or overflow tube or pipe 4 of a toilet tank (not shown). Two arms 3*a*, functioning as an attachment means, extending from the flapper 3 are anchored at hangers or pivots 5 on the overflow pipe 4. The flapper 3 rotates about the pivots 5 in plane D between a lower closed position, seating on an outlet 4*b*, and an upper open position, suspended above the outlet 4*b*.

Simply, the turning moment shifting means 2 is adapted to a flapper valve 3 for varying its rate of closing during a flush. The shifting means 2 comprises a weight 6 which can shift along a guide 7 and further incorporates a valve operating mechanism 8 for opening the valve 3. Coordinated with the operating mechanism 8 is a weight retaining means or latch 9 for determining whether the weight 6 shifts or not.

Normally, the weight 6 resides over the flapper 3, furthest from the pivot 5 for imposing maximal turning moment to close the flapper 3 and ensuing a short flush. Through a further activating action, the weight 6 can be enabled to shift closer to the pivot 5 for minimizing the turning moment, lessening the impetus to close the flapper 3 and ensuing a longer flush. Once flushed, the weight 6 shifts back to reset the latch 9 so as to again be retained over the flapper 3, for a short flush, until activated once again.

Figure 2:
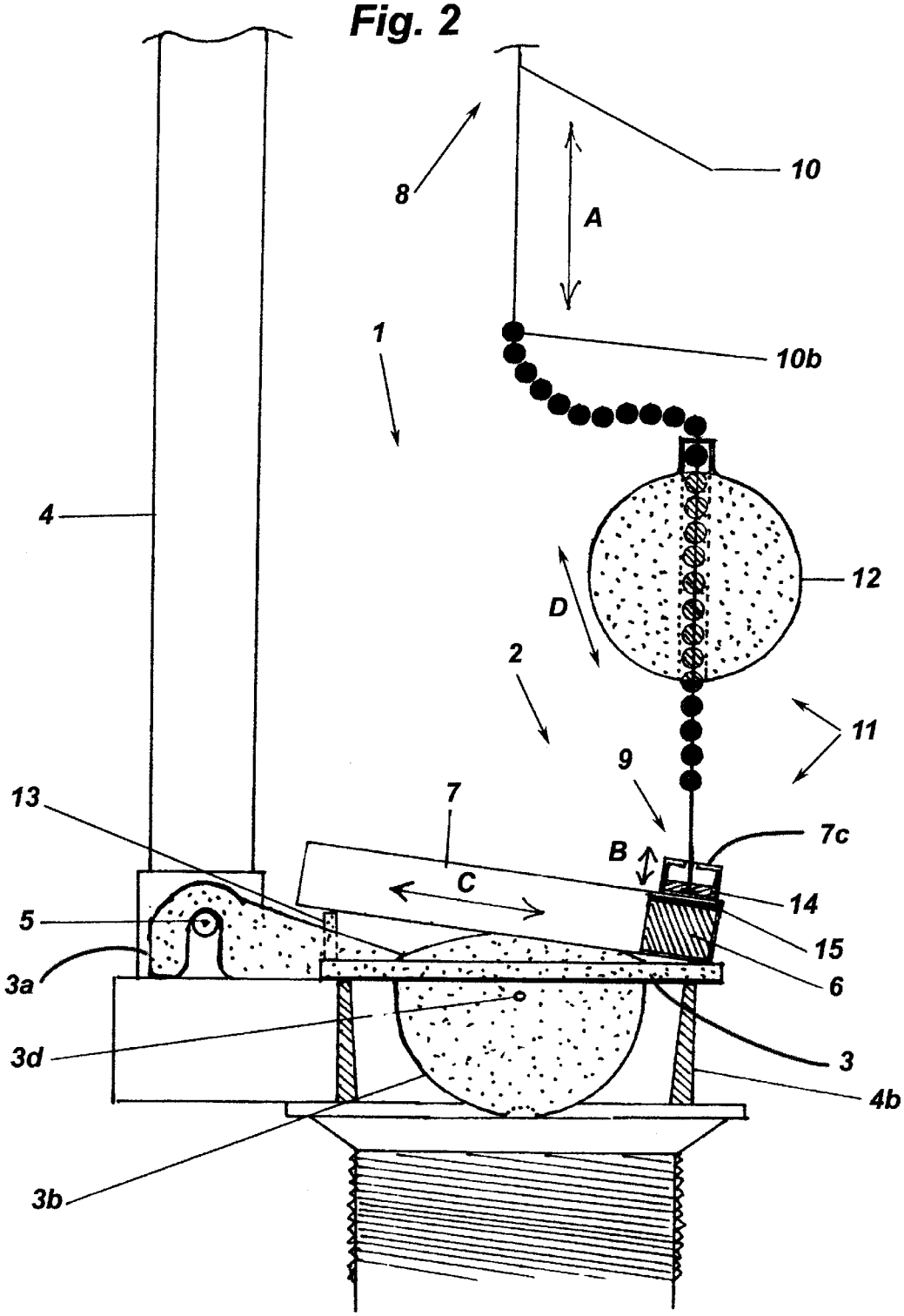
FIG. 2 is a side view of the invention according to FIG. 1 shown with the valve assembly in the normally closed position.

As shown in FIG. 2, the assembly 1 is normally closed; with the flapper 3 sealed to the outlet 4*b*, and wherein the tank is ready to flush. The assembly 1 is activated or opened by the valve operating mechanism 8 which raises the flapper 3 with a chain or other suitable tensile connector 10, causing the flapper 3 to rotate about the pivots 5. Typically, the valve operating mechanism 8 includes a flush handle (not shown) connected to a lift arm (not shown) which in turn is connected to the chain 10; the other end of the chain 10 being attached to the assembly 1.

To prevent the flapper 3 from prematurely closing and sealing the outlet 4*b*, flush sustaining means 11 are provided to counteract the flapper's natural tendency to close and thereby maintain the assembly 1 in the open position for a predetermined amount of time. The sustaining means 11 could include a traditional air chamber 3*b* and release hole 3*d* incorporated in the flapper 3, a float 12 attached to the chain 10, or a combination thereof. Depending on the composition of the flapper 3 or assembly 1, the sustaining means 11 could also consist of solely the inherent buoyancy in such a flapper or assembly. When there is no reduction in the moment arm of the assembly 1, the sustaining means 11 keep the assembly 1 in the open position for a predetermined time which is less than the time needed to substantially drain the tank, resulting in a short flush.

Figure 3:
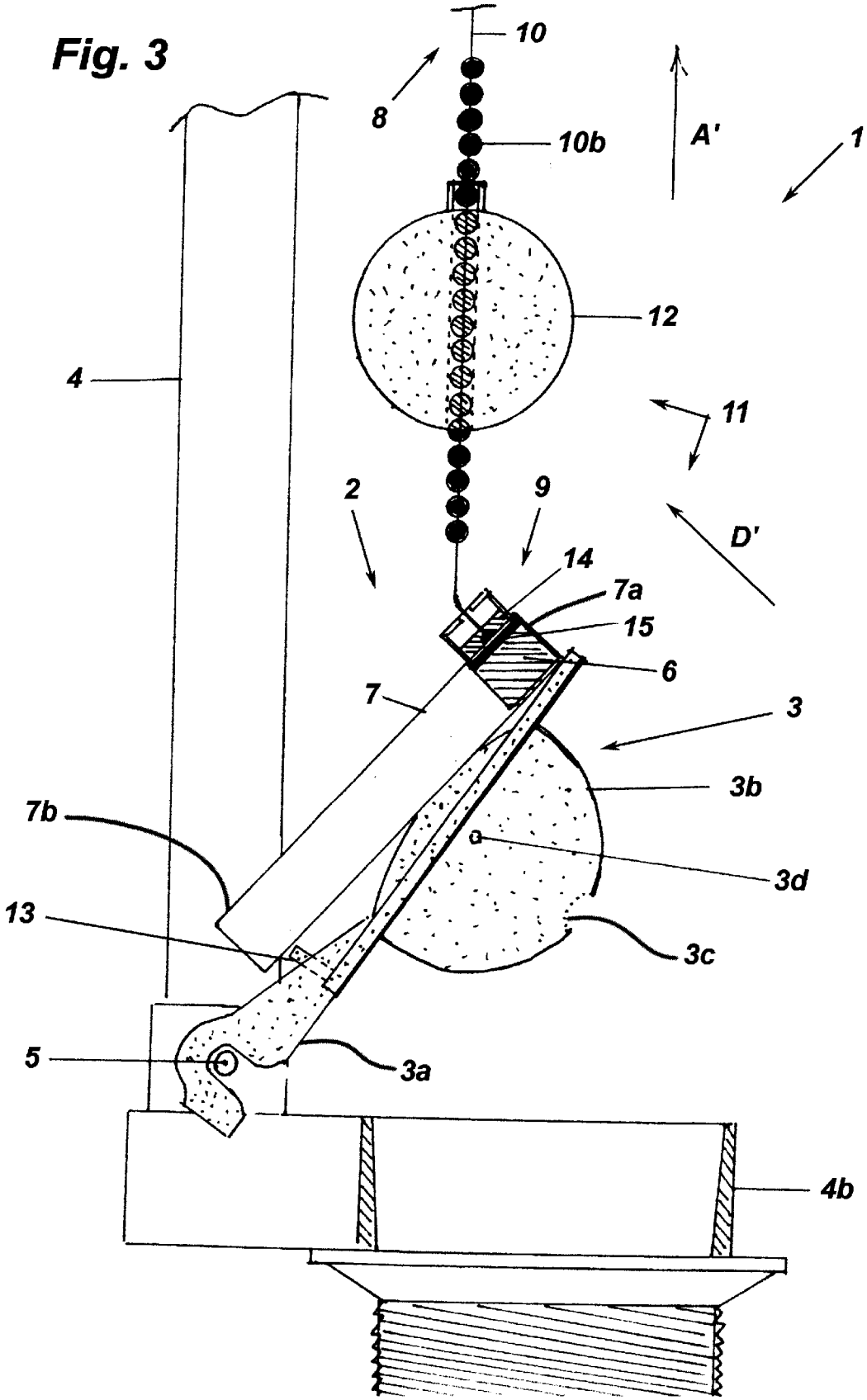
FIG. 3 is a side view of the invention according to FIG. 1 shown with the valve assembly in a first open position.
Figure 4:
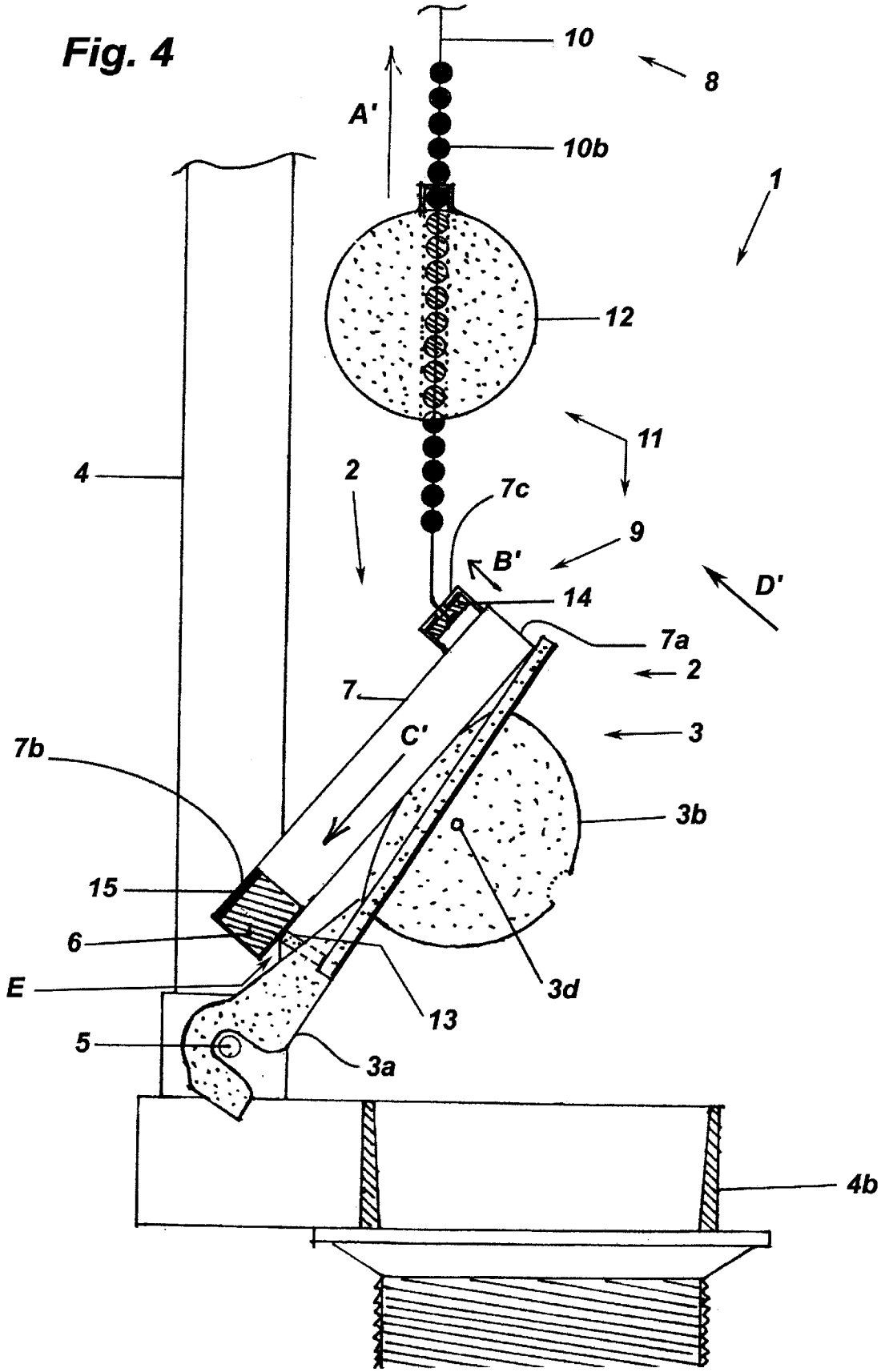
FIG. 4 is a side view of the invention according to FIG. 1 shown with the valve assembly in a second open position engaging the overflow tube.
Figure 5:
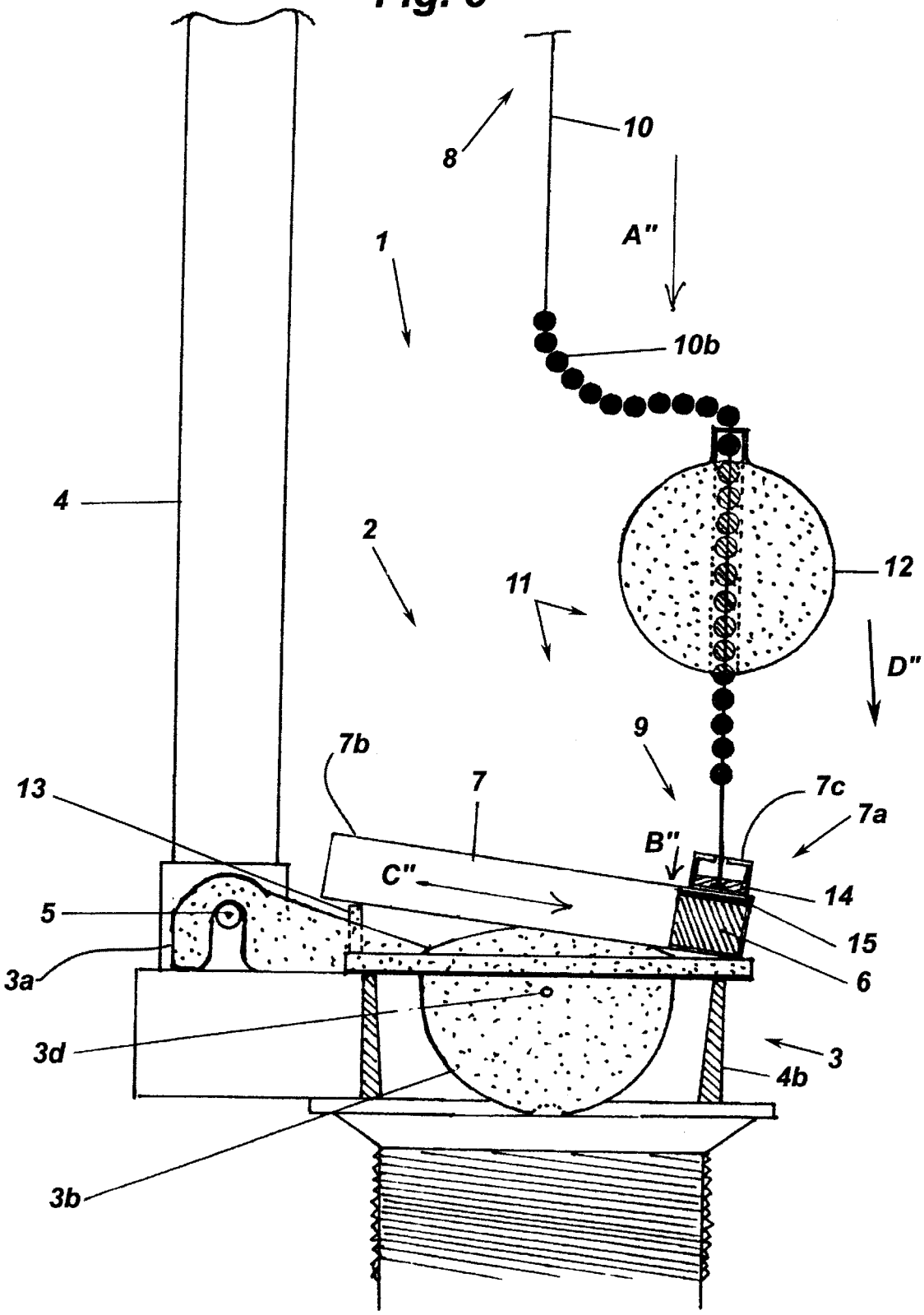
FIG. 5 is a side view of the invention according to FIG. 1 shown with the valve assembly having returned to the normally closed position.
Figure 6:
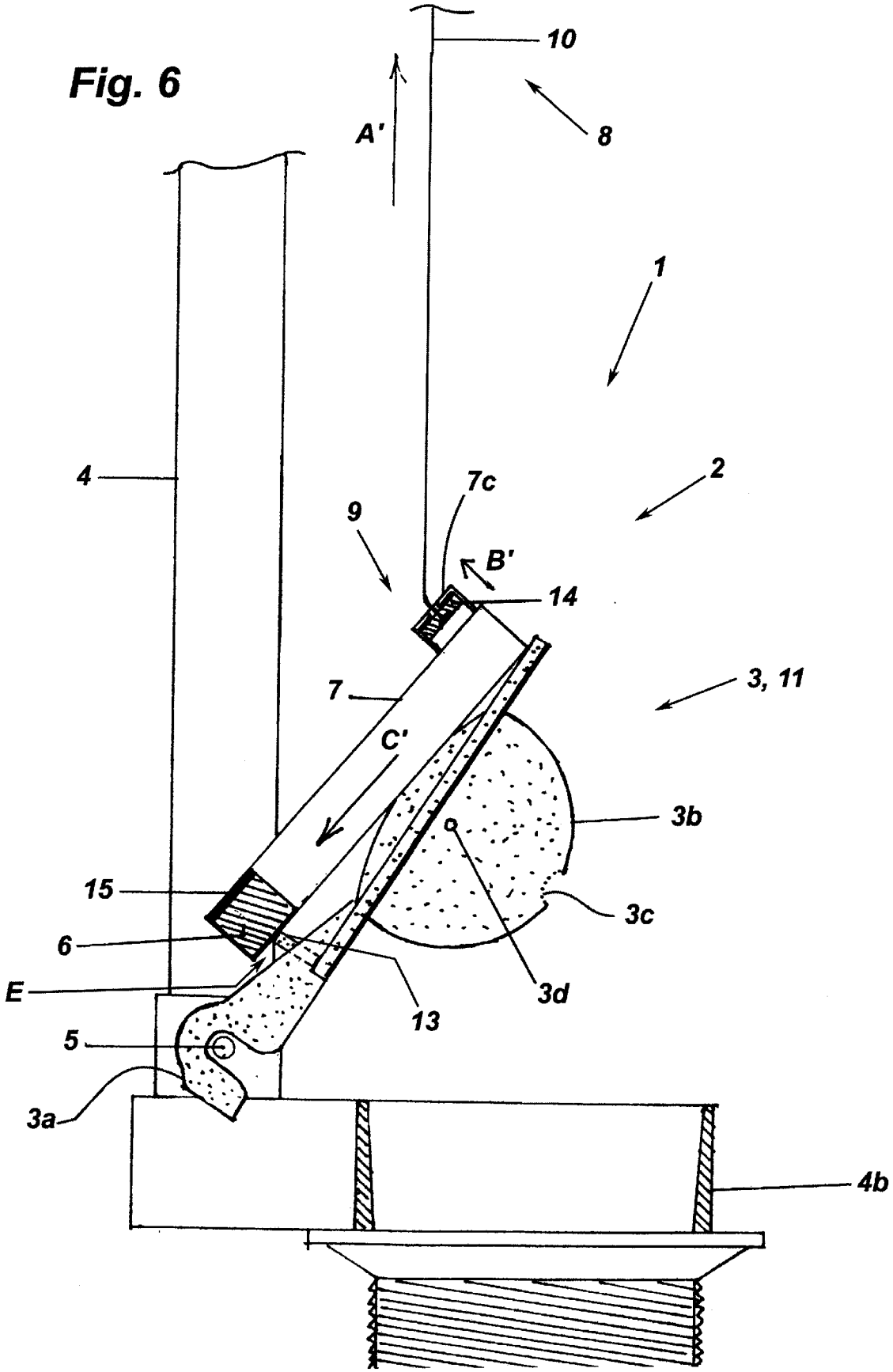
FIG. 6 is a side view of a second embodiment of the invention, with air chamber sustaining means only, and shown with the valve assembly in an open position and engaging the overflow tube.
Figure 7:
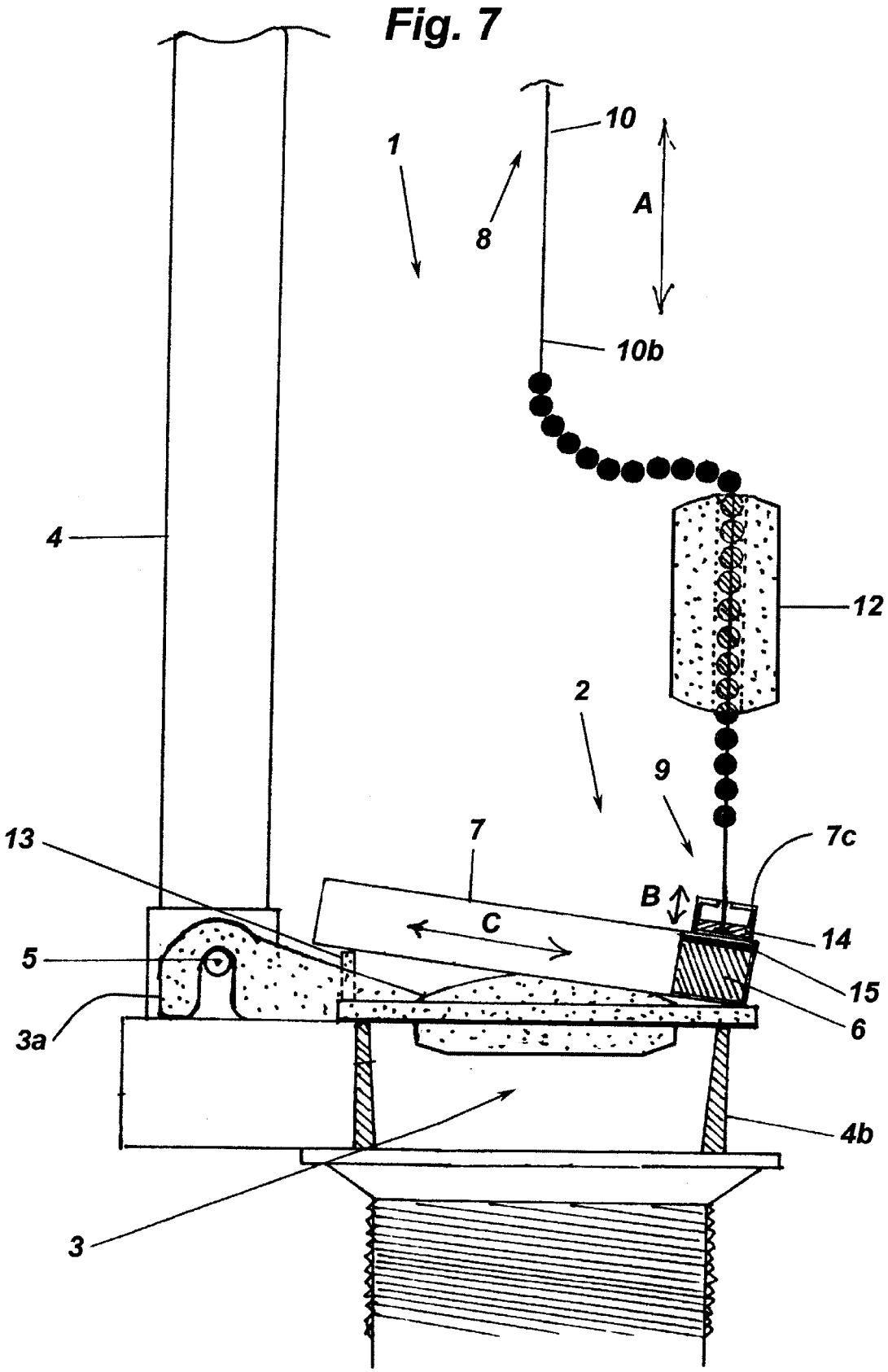
FIG. 7 is a side view of a third embodiment of the invention, with float sustaining means only, and shown with the valve assembly in the normally closed position.

In this embodiment, FIGS. 2–5, the sustaining means 11 is illustrated as the combination of air chamber 3*b* and float 12, although other configurations are also suitable (e.g. FIG. 6 with air chamber 3*b* only, or FIG. 7 with float 12 only). The air chamber 3*b* has an opening 3*c* through the bottom and a release hole 3*d* of predetermined size. Further in this embodiment, the float 12 is adjustably attached to the chain 10 by means of a length of beads 10*b* of conventional design. As shown in FIG. 3, during a flush operation, with the flapper 3 inclined, air escapes through the release hole 3*d* at a predetermined rate, reducing the buoyancy of the flapper 3, while the float 12 provides additional buoyancy until the water drops to the level of the float 12. The combination of buoyant flapper 3, and float 12 cause the assembly 1 to close after the predetermined time. Adjusting the float 12 along the bead chain 10*b* will adjust the length of the predetermined amount of time.

For enabling actuating distinction between a short flush and a long flush, means are provided for limiting the upward rotation of the assembly 1. For instance, a protrusion or stop 13 is formed on the flapper 3 adjacent the overflow pipe 4. As shown in FIG. 4, when the flapper 3 is rotated about the pivots 5 to an extreme upward or open position, the stop 13 contacts the overflow pipe 4, creating a resistance force at point E and limiting any further opening. In alternate embodiments, with flappers lacking a discrete stop 13, that portion of the flapper 3 which first contacts the overflow pipe 4 acts as the stop 13.

Generally, in the embodiment of FIGS. 1–5, the weight 6 moves back and forth to shift the turning moment of the flapper 3. The turning moment arm shifting means 2 comprises a longitudinal guide or sleeve 7. The weight 6 is moveably constrained within the sleeve 7 along axis C. The shifting means 2 further comprises a latch 9 such as magnetic coupling device 14, 15 to control movement of the weight 6. Note that other configurations of a weight 6 and guide 7 are possible and that the weight need not be constrained within the guide 7 as long as the weight 6 is constrained for movement along the guide 7. For example, a weight could be fitted around a guide.

The sleeve 7 has first and second ends 7*a*, 7*b*, mounted for displacement with the assembly 1 and axially aligned substantially parallel to the flapper 3. The first end 7*a* is further from the pivot point 5 than the second end 7*b* and, when the assembly 1 is in the lower closed position, the first end 7*a* is slightly lower than the second end 7*b* so that the weight 6 can move to the first end 7*a* and reset. The sleeve 7 is angled laterally relative to the longitudinal axis of the assembly 1 (FIG. 1) so as to permit the sleeve 7 to be relatively long, more closely approaching the pivot 5, for maximum variation in the shifting of the weight 6 while still avoiding contact with the overflow tube 4. When the assembly 1 is closed, the moveable weight 6 shifts towards the lower first end 7*a* due to gravity pulling the weight 6 in direction C" (FIG. 5).

Referring to FIGS. 3 and 4, in order to allow a user to decide between a short or long flush, a latch 9 having a short flush and a long flush position is provided to alternatively keep the weight 6 positioned near the first end 7*a*, or to allow the weight 6 to shift to the second end 7*b*. The latch 9, or magnetic coupling device 14, 15 in one embodiment, is shown as a first magnetic coupler or magnet 14 attached to the end of the chain 10 and a corresponding magnetically affected material of a second magnetic coupler or magnet 15 is associated with the weight 6. Other constructions of magnet, magnets, magnetic couplers or complementary materials are equivalent, referred to herein simply as magnets 14, 15. The magnet 14 is enclosed in a chamber 7*c*, at the sleeve's first end 7*a*, so that it is limited to a small movement or displacement along axis B, but such displacement when so activated is sufficient to break the magnetic attraction between the magnets 14 and 15. Therefore, the magnets 14, 15 act as a biasing means to maintain the latch 9 in the short flush position and the chamber 7*c* acts as a displacement limiting means to limit magnet 14 to a small movement along axis B.

As shown in FIG. 3, the magnetic attraction between the magnets 14, 15 in turn is sufficiently strong to keep the weight 6 at the sleeve's first end 7*a* and allow for a first tension in the chain 10 and a tensile force in direction A' to be transmitted from the chain 10 to the assembly 1 (via weight 6 and sleeve 7), until the assembly 1 encounters a sufficient resistance force. If little resistance force is encountered then the assembly 1 merely pivots upward in plane D, opening the flapper valve 3, causing the flushing process to begin until the sustaining means allows the valve 3 to close after the predetermined amount of time. Alternately, a larger and second tension results and a sufficient resistance force for a long flush is created when the upward rotation of the assembly 1 in plane D is limited by the stop 13 contacting the tube 4 at point E.

Alternatively, a sufficient resistance force is created when the chain 10 is raised faster than normal (e.g. a quick, vigorous lift) and the inertia of the assembly 1 and the resistance to movement retards the assembly's motion.

Referring again to FIG. 4, the stop 13 is shown engaging the overflow tube 4 at point E. The rotation of the assembly 1 in direction D is stopped. Continued pulling and increased second tension in the chain 10 creates a resistance force at point E, which is transmitted through the assembly 1 and is sufficient to release the magnet coupling device 14, 15 free of the weight 6. Once the magnetic attraction is broken between magnets 14, 15, and with the guide inclined, the weight 6 is freed to slide in direction C' to the sleeve's second end 7*b*; the second end 7*b* now being lower than the first end 7*a* by virtue of the assembly 1 having pivoted in direction D'. The movement of the weight 6 moves the center of gravity of the assembly 1 towards the pivot 5 and the turning moment arm about the pivots 5 is thereby reduced. The reduction of the assembly's turning moment arm allows the sustaining means 11 to keep the flapper 3 open for a time longer than the predetermined time, resulting in a larger discharge of water into the toilet bowl.

Further Embodiment

Now with reference to FIGS. 8–12, in another embodiment, the flush valve assembly 1 is again provided with the turning moment arm shifting means 2. However, the weight 6 is retained or biased at the sleeve's first end 7*a*, not by a magnetic coupling latch, but by a pivoting lever mechanism 20 or latch 9.

Figure 8:
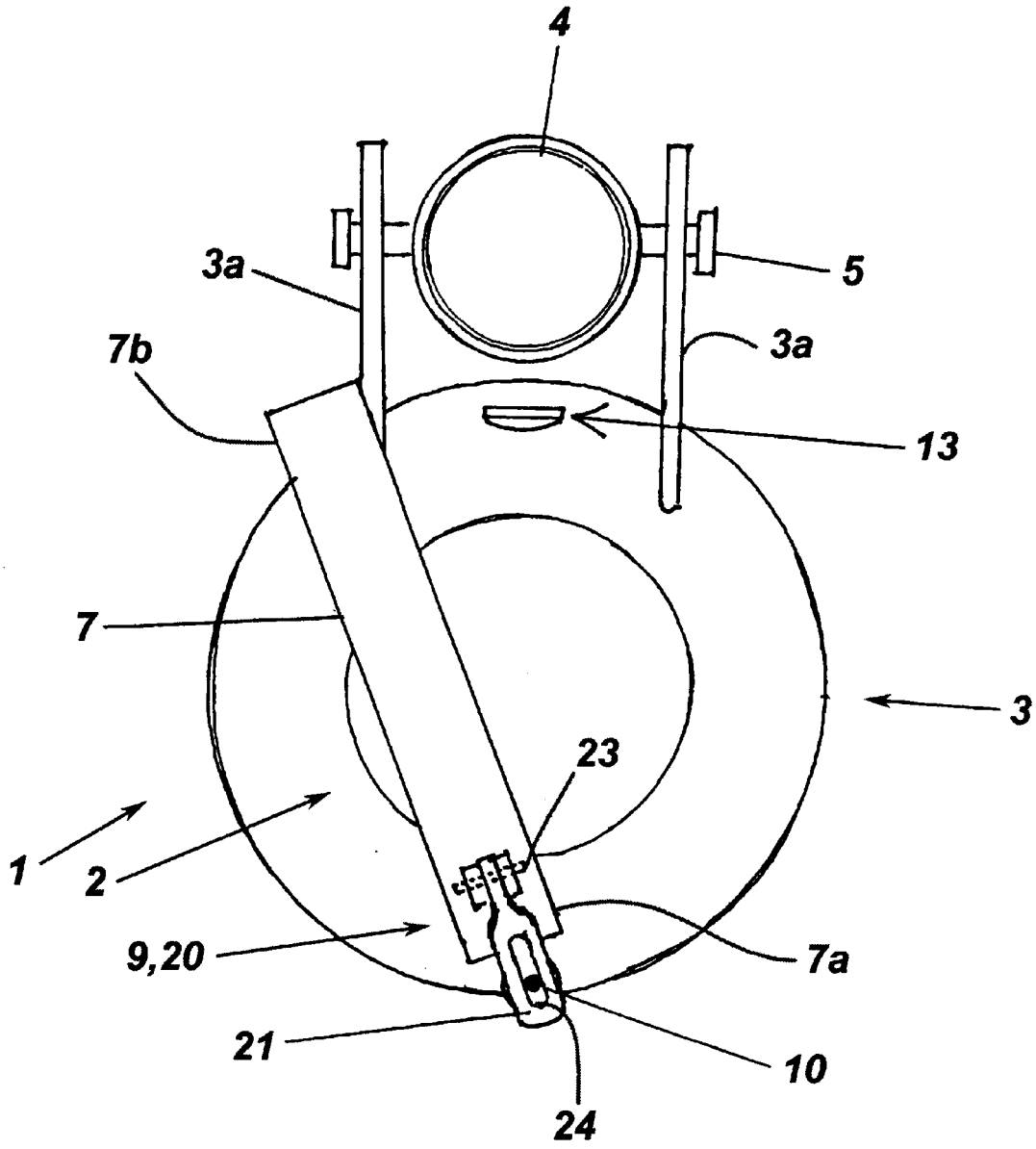
FIG. 8 is a top view of a fourth embodiment of the invention.
Figure 9:
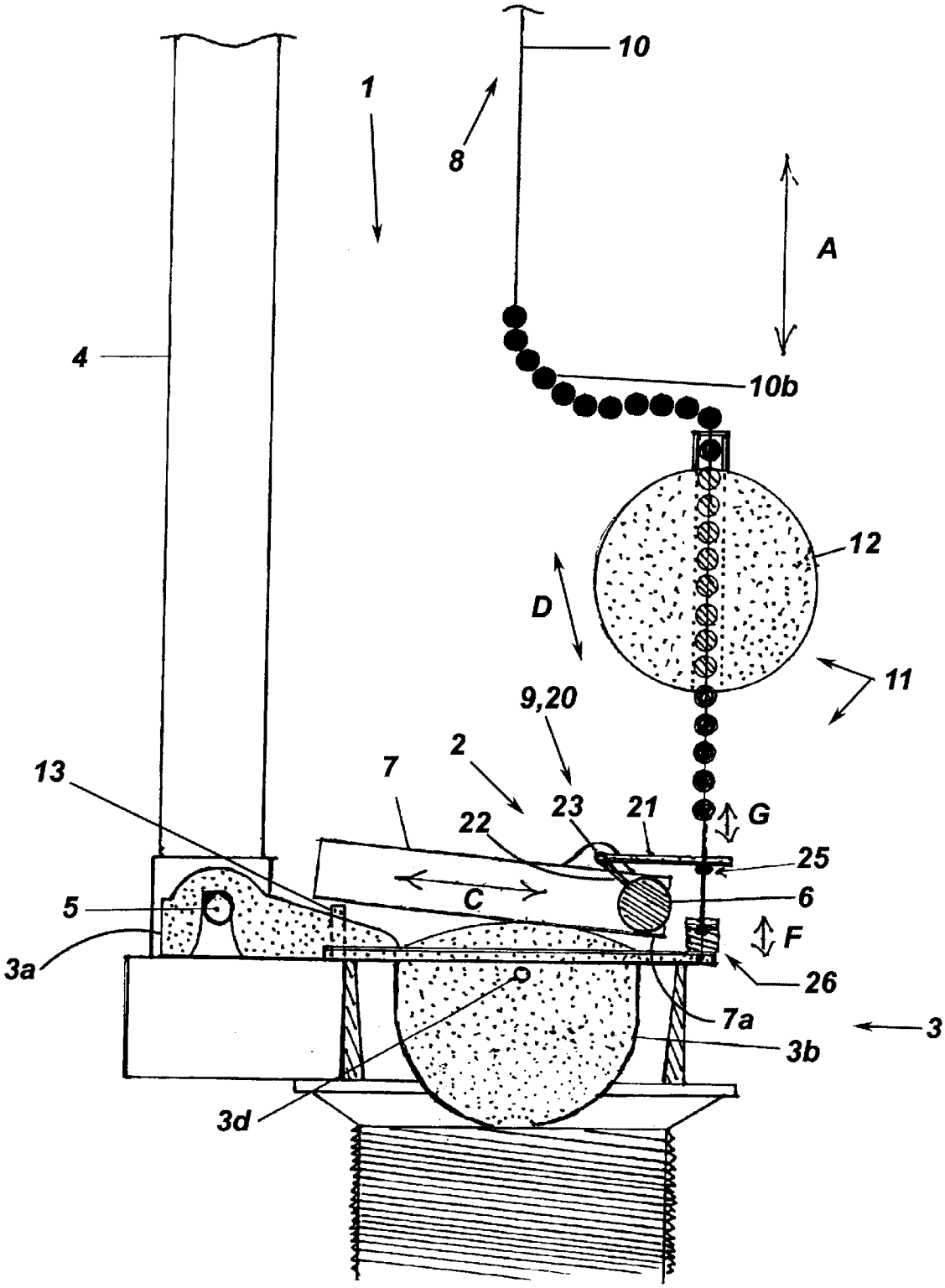
FIG. 9 is a side view of the invention according to FIG. 8 shown with the valve assembly in the normally closed position.

With reference to FIG. 8, the pivoting lever mechanism 20 comprises a lever 21 with a stop 22 depending downward from it at an acute angle. One end of the lever 21 is attached to the upper portion of the sleeve 7, near the first end 7*a*, at point 23. The other end of the lever 21 features a slot 24 through which the chain 10 is positioned and constrained (FIG. 8). Although shown comprising a lever 21 with a stop 22 depending down at an acute angle, the pivoting level mechanism 20 could incorporate levers of a different design or which are mounted at a different pivot point.

The stop 22 extends from the lever 21 at the pivot point 23 and projects into the interior of the sleeve 7. The stop 22 engages the weight 6 and functions to retain or bias the weight 6 at end 7*a*. A tab 25, which is larger than the width of the slot 24, is positioned on the chain 10 just below the lever's slot 24. Finally, a lever reset spring 26 is attached between the chain 10 and the flapper 3. In this embodiment the weight 6 is shaped as a ball for rolling movement, but other shapes are possible.

Figure 10:
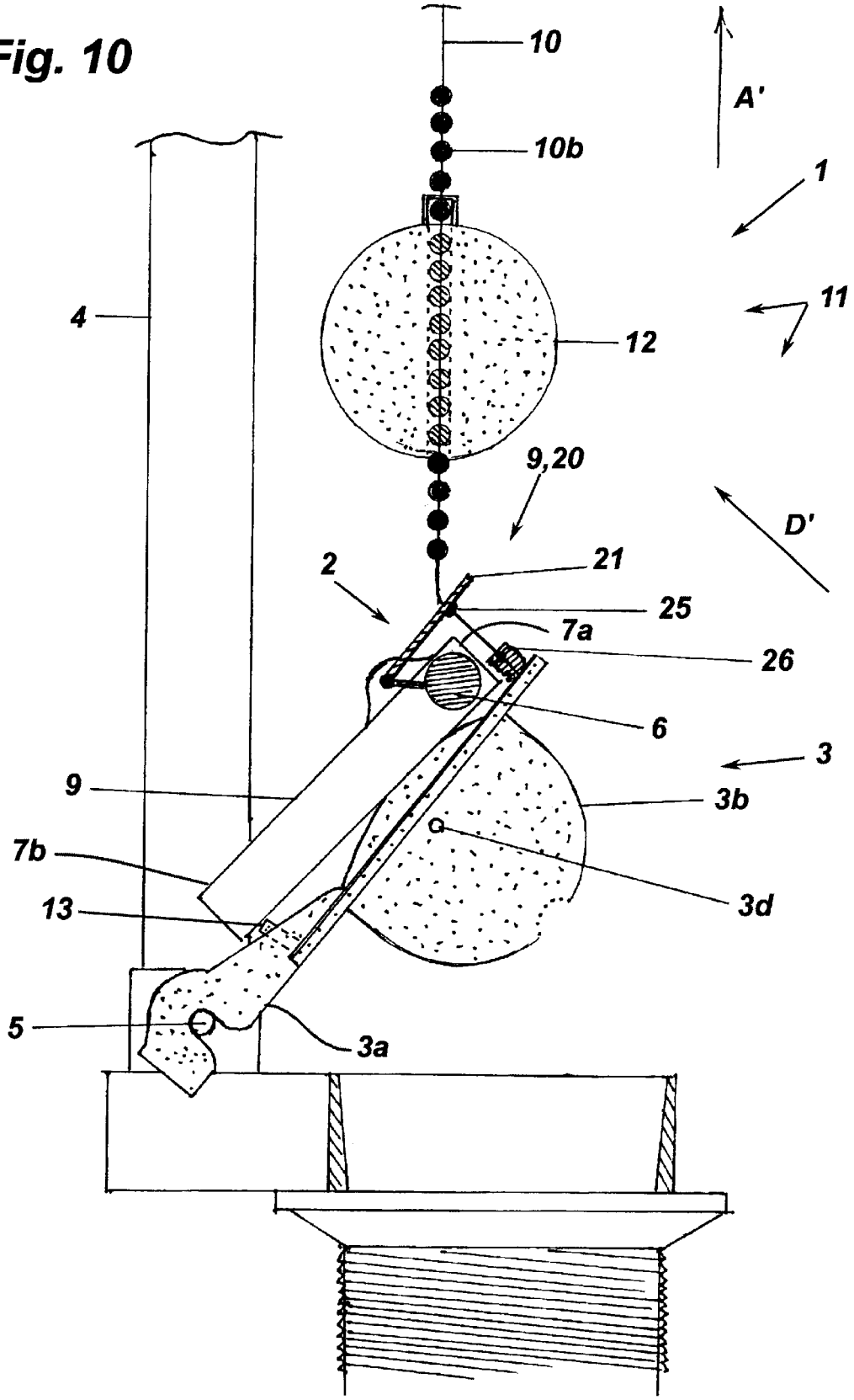
FIG. 10 is a side view of the invention according to FIG. 8 shown with the valve assembly in a first open position.

Turning to FIG. 10, the tension in the spring 26 is sufficiently strong to allow for a tensile force in direction A' to be transmitted from the chain 10 to the flapper 3 retaining the weight 6 until the assembly 1 encounters a sufficient resistance force. A sufficient resistance force is created when the upward rotation of the assembly 1 in plane D is limited. Alternatively, a sufficient resistance force is created when the chain 10 is raised faster than normal and the inertia of the water in the tank acts on the assembly 1. Therefore, the pivoting lever mechanism 20 and spring 26 act as a biasing means to maintain the latch 9 in the short flush position.

Figure 11:
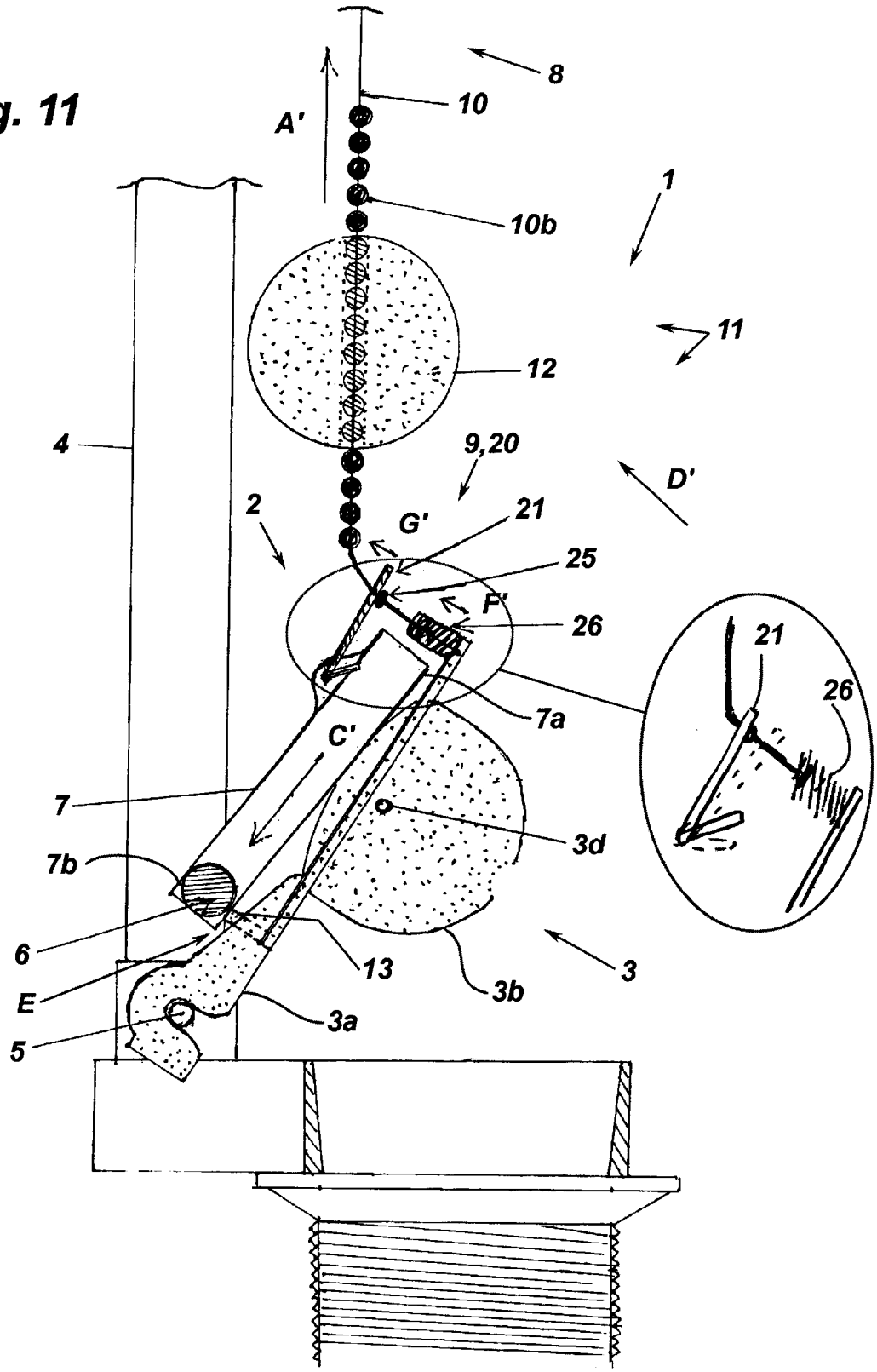
FIG. 11 is a side view of the invention according to FIG. 8 shown with the valve assembly in a second open position engaging the overflow tube.

Referring now to FIG. 11, the stop 13 is shown engaging the overflow tube 4 at point E. The rotation of the assembly 1 in direction D' is stopped. Continued pulling of the chain 10 creates a resistance force at point E, which is transmitted through the assembly 1 and is sufficient overcome the spring 26 thereby lengthening it. Once the spring 26 lengthens (F'), the tab 25 acts on the lever 21, 24 and pivots the lever 21 in direction G'. As the lever 21 pivots, the stop 22 disengages from the weight 6 and allow the weight 6 to move in direction C' to the sleeve's second end 7*b*. The second end 7*b* is now lower than the first end 7*a*, by virtue of the assembly 1 having pivoted in direction D, and gravity pulls the weight 6 to the second end 7*b*. The movement of the weight 6 moves the center of gravity of the assembly 1 and the turning moment arm about the pivots 5 is thereby reduced, keeping the flapper 3 open for a time longer than the predetermined time and resulting in a larger discharge of water into the toilet bowl.

Figure 12:
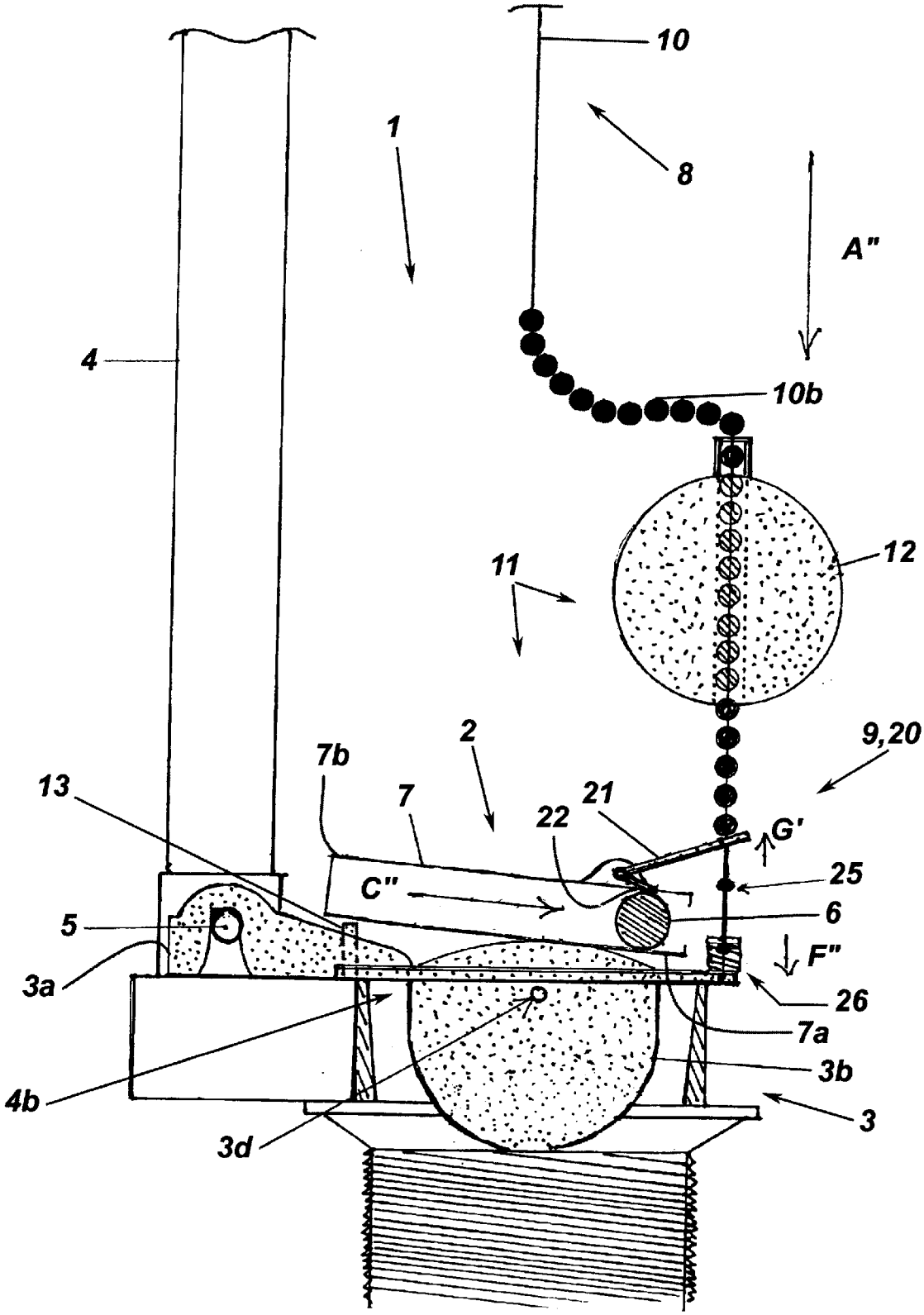
FIG. 12 is a side view of the invention according to FIG. 8 shown with the valve assembly returning to the normally closed position.

Referring to FIG. 12, the assembly 1 is shown returning to the normal position; with the flapper 3 closing the outlet 4*b*. As the chain 10 is lowered in direction A" the resistance force is gone and the spring 26 contracts back to its normal size in direction F". The sleeve's first end 7*a* is once again lower than the second end 7*b*, and gravity causes the weight 6 move down to the first end 7*a*. As the weight 6 shifts back to the first end 7*a* it engages the stop 22, bumping the stop 22 and the lever 21 up to allow the weight 6 to pass. The lever 21, guided by the chain 10 constrained in the slot 24, simply pivots up in direction G' until the weight is past the stop 22; at which point gravity pulls the lever 21 down, thereby re-engaging the stop 22 with the weight 6 so as to retain the weight 6 at the first end 7*a*. In this way, the shifting means 2 is reset, ready to be activated by the next sufficient resistance force, to reduce the assembly's 1 turning moment arm once again.

Summary of Operation

Referring generally to FIGS. 3,4, 10 and 11, through a conventional flush handle or other operating mechanism, the user operates the assembly 1 in the conventional way by exerting a lifting tensile force (A') on the assembly 1 through the chain 10, causing the assembly 1 to rotate about the pivots 5. For instance, one known flush handle from Korea is a dual-flush handle which uses a downward rotation of the handle to result in a short chain lift and an upward rotation of the handle to result in a long chain lift.

For a short flush, a short chain lift opens the flapper 3 and does not encounter sufficient resistance to activate the weight shifting means 2 and the assembly's turning moment arm remains maximal and unchanged. The sustaining means 11 keeps the assembly 1 open for a short flush.

For a long flush, a long chain lift rotates the flapper 3 until it is stopped, resulting in sufficient resistance force to activate the shifting means 2, releasing the weight 6 to move closer to the pivot 5, minimizing the assembly's turning moment arm. With a reduced turning moment arm, the sustaining means 11 is able to keep the assembly 1 open for a longer time; resulting in a long flush.

Figure 13A:
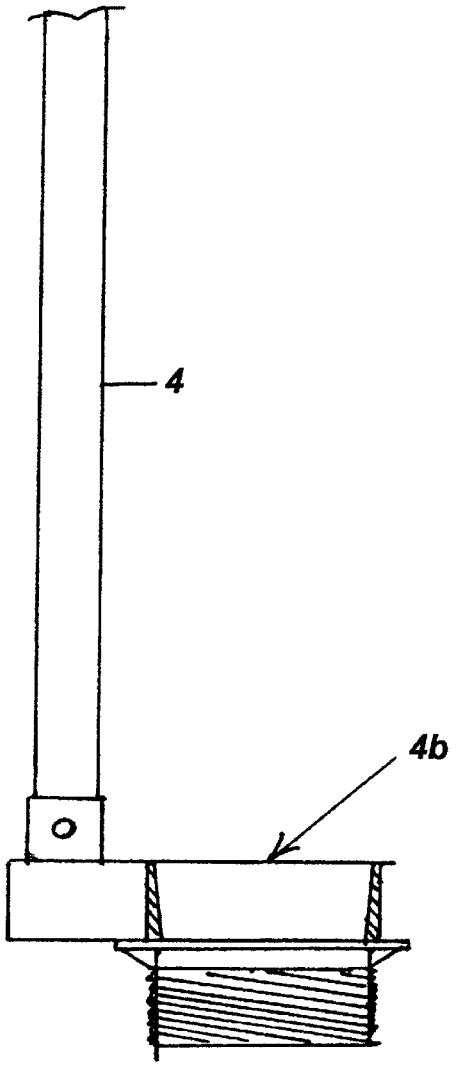
FIG. 13*a* is a side view of one model of flush valve having a generally horizontal outlet.
Figure 13B:
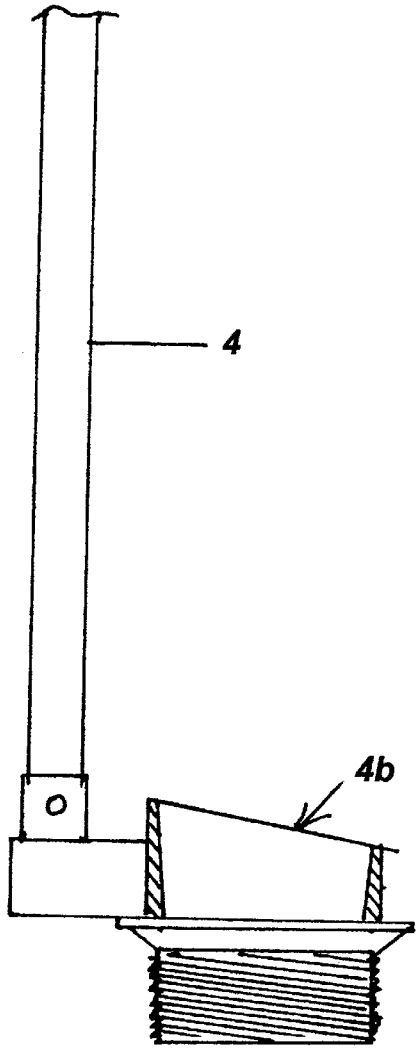
FIG. 13*b* is a side view of another model of flush valve having an angled outlet.

As shown in FIG. 13, the flapper outlet 4*b* can be horizontal or on an angle without effecting the nature of the invention.

The embodiments of the invention in which an exclusive property or privilege is being claimed are defined as follows:

1. A dual flush assembly for a flapper valve having a valve rotatable about a pivot when actuated for opening the valve, the assembly comprising:

a guide adapted to the valve and extending at least a partly between the valve and the pivot;

a weight movable along the guide for varying a turning moment of the weight, guide and valve about the pivot; and a resettable latch adapted for connection to a tensile member for actuating the latch between two positions, a short flush position wherein when the valve is pivoted upwardly, the latch remains latched and the weight is maintained adjacent the valve for maximizing the turning moment for closing the valve, and a long flush position wherein when the valve is pivoted upwardly, the latch is released so the weight moves closer to the pivot, for minimizing the turning moment to close the valve, and once the valve closes, the weight moves adjacent the valve and the latch resets in the short flush position.

2. The dual flush assembly of claim 1 wherein the latch comprises:

a biasing means to maintain the latch in the short flush position so that a first tension on the tensile connector is sufficient to open the valve but not sufficient to overcome the biasing means, and a second tension on the tensile connector, greater than the first tension, is sufficient to open the valve and to overcome the biasing means and thereby actuate the latch to the long flush position.

3. The dual flush assembly of claim 2 wherein the biasing means comprises a magnetic coupling device wherein the weight is a first magnetic coupler, further comprising:

a second complementary magnet coupler positioned adjacent a valve end of the guide for magnetic coupling with the weight; and means for limiting displacement of the second magnetic coupler, so that the first tension on the tensile connector is sufficient to open the valve but not sufficient to overcome the magnetic coupling device, and the second tension on the tensile connector is sufficient to overcome the magnetic coupling device, displace the second magnetic coupler subject to the displacement limiting means, and release the latch.

4. The dual flush assembly of claim 2 wherein the latch further comprises a pivoting lever mechanism.

5. The dual flush assembly of claim 4 wherein the biasing means comprises a spring device, wherein:

the first tension on the tensile connector is sufficient to open the valve but not sufficient to overcome the spring device, and the second tension on the tensile connector is sufficient to overcome the spring device, actuate the pivoting lever mechanism and release the latch.

6. The dual flush assembly of claim 1 wherein the guide is angled laterally relative to a longitudinal axis of the assembly so as to permit the guide to extend adjacent the pivot and thereby be of a maximum length for a maximum variation in both the movement of the weight and turning moment.

7. A method for varying flush capability for toilets having a flapper valve rotatable about a pivot when actuated with a tensile member for opening the valve, comprising:

providing a guide adapted to the valve and extending at least partly between the valve and the pivot providing a weight movable along the guide between the valve and the pivot for varying a turning moment of the weight and valve about the pivot;

providing a resettable latch which is connected between the valve and the tensile member and which is biased in the latched position for maintaining the weight adjacent the valve;

lifting the latch and valve with the tensile member; and applying tension in the tensile member for actuating the latch between two positions, a short flush position wherein when the valve is pivoted upwardly, the latch remains latched and the weight is maintained adjacent the valve for maximizing the turning moment for closing the valve, and a long flush position wherein when the valve is pivoted upwardly, the latch is released so the weight moves closer to the pivot, for minimizing the turning moment to close the valve, and once the valve closes, the weight moves adjacent the valve for resetting the latch in the short flush position.

8. The method of claim 7 further comprising:

providing biasing means to maintain the latch in the short flush position so that a first tension on the tensile connector is sufficient to open the valve but not sufficient to overcome the biasing means, and a second tension on the tensile connector, greater than the first tension, is sufficient to open the valve, overcome the biasing means thereby releasing the latch.

9. The method of claim 7 further comprising:

providing a magnetic coupling device to maintain the latch in the short flush position so that a first tension on the tensile connector is sufficient to open the valve but not sufficient to overcome the magnetic coupling device, and a second tension on the tensile connector is sufficient to open the valve, overcome the magnetic coupling device thereby releasing the latch.

10. The method of claim 7 further comprising:

providing a spring device to maintain the latch in the short flush position so that a first tension on the tensile connector is sufficient to open the valve but not sufficient to overcome the spring device, and a second tension on the tensile connector is sufficient to open the valve, overcome the spring device thereby releasing the latch.

* * * * *